US012442606B2

(12) United States Patent
Zhang et al.

(10) Patent No.: US 12,442,606 B2
(45) Date of Patent: Oct. 14, 2025

(54) LOCK FOR GUN AND MULTIFUNCTIONAL GUN STORAGE STAND

(71) Applicant: Shenzhen Hanmai Technology Co., Ltd, Shenzhen (CN)

(72) Inventors: Wenyuan Zhang, Zhangshu (CN); Chaofeng Sun, Shenzhen (CN)

(73) Assignee: Shenzhen Hanmai Technology Co., Ltd, Shenzhen (CN)

( * ) Notice: Subject to any disclaimer, the term of this patent is extended or adjusted under 35 U.S.C. 154(b) by 0 days.

(21) Appl. No.: 18/497,107

(22) Filed: Oct. 30, 2023

(65) Prior Publication Data

US 2024/0060739 A1 Feb. 22, 2024

(30) Foreign Application Priority Data

Jun. 14, 2023 (CN) ..... 202321513876.7

(51) Int. Cl.
*F41A 17/02* (2006.01)
*A47B 81/00* (2006.01)
*F41A 17/06* (2006.01)

(52) U.S. Cl.
CPC ..... *F41A 17/02* (2013.01); *A47B 81/005* (2013.01); *F41A 17/066* (2013.01)

(58) Field of Classification Search
CPC ..... F41A 17/02; F41A 17/06; F41A 17/066; F41A 17/46; F41A 17/54; A47B 81/005
USPC ..... 42/70.06–70.7
See application file for complete search history.

(56) References Cited

U.S. PATENT DOCUMENTS

| | | | | |
|---|---|---|---|---|
| 3,269,046 | A * | 8/1966 | Schaefer | F41A 17/54 42/70.07 |
| 6,205,695 | B1 * | 3/2001 | Schnell | F41A 17/54 42/70.07 |
| 6,253,480 | B1 * | 7/2001 | Florez | F41A 17/06 42/70.07 |
| 8,006,424 | B1 * | 8/2011 | Ligard | F41A 17/02 42/70.11 |
| 10,190,837 | B1 * | 1/2019 | Vafadar | F41G 11/003 |
| 2019/0093969 | A1 * | 3/2019 | Pintar | A47B 81/005 |
| 2019/0204035 | A1 | 7/2019 | Biran et al. | |
| 2020/0271407 | A1 * | 8/2020 | Lied | F41A 17/54 |
| 2023/0080334 | A1 | 3/2023 | Hamilton | |
| 2023/0408218 | A1 * | 12/2023 | Halverson | F41A 17/46 |

FOREIGN PATENT DOCUMENTS

| | | | | |
|---|---|---|---|---|
| CN | 108835958 A | * 11/2018 | | A47B 81/00 |
| CN | 113237383 A | * 8/2021 | | F41C 33/02 |

* cited by examiner

*Primary Examiner* — Troy Chambers
*Assistant Examiner* — Benjamin S Gomberg
(74) *Attorney, Agent, or Firm* — Hemisphere Law, PLLC; Zhigang Ma

(57) ABSTRACT

The present disclosure relates to the technical field of gun locks, and particularly, to a lock for safety protection of a gun trigger and a multifunctional gun storage stand. The lock includes a base, a shell fixedly connected to the base, a stabilizer fixedly connected to the shell, and a locking device mounted inside the shell. The locking device is provided with a movably opened and closed lock catch assembly and a locking assembly restraining the lock catch assembly from being movably opened and closed; the lock catch assembly is movably connected to the locking assembly, and the lock catch assembly is provided with a lock catch post.

9 Claims, 12 Drawing Sheets

LOCK FOR GUN AND MULTIFUNCTIONAL GUN STORAGE STAND

TECHNICAL FIELD

The present disclosure relates to the technical field of gun locks, and particularly, to a lock for a gun and a multifunctional gun storage stand.

BACKGROUND

A gun is a short-barrel weapon that is held with one hand for aimed or instinctive shooting. It is usually carried by a user and is used for self-defense and surprise attack within a range of 50 meters. For security personnel, they usually carry a gun during their outdoor duty. In indoor office environments, they usually take down the gun for storage.

Chinese patent document with the publication (announcement) number CN212154437U discloses a gun lock, which includes a lock shell, wherein the lock shell is provided with a notch, and lock holes are oppositely formed in two walls of the notch; and a lock device, wherein the lock device and the lock shell are arranged in a matched manner, and the lock device includes a driving assembly, a first elastic piece, a locking assembly, and a lock rod; the lock rod is arranged in the lock holes in a sliding manner; a locking space is formed by the lock rod and a bottom wall of the notch; the first elastic piece is arranged in the lock holes; the lock rod slides into the lock holes, compresses the first elastic piece, and is locked with the locking assembly; the driving assembly drives the locking assembly to be separated from the lock rod; and the first elastic piece returns to drive the lock rod to slide out along the lock holes. The gun lock can drive the lock rod to slide into the lock holes to be locked with the locking assembly, and locks a trigger of a gun through the locking space, so as to prevent situations that the trigger is triggered and the gun cannot be used after being stolen. After the driving assembly drives the locking assembly to be separated from the lock rod, the first elastic piece can enable the lock rod to automatically pop out of the lock holes, so that the lock rod can be conveniently pulled outwards to be separated from the trigger to achieve unlocking.

Although the gun lock described above can lock the trigger of the gun to prevent the trigger from being triggered, the structure of the gun lock is complex, and there are too many unlocking steps, making it inconvenient to quickly take down the gun in an emergency. Moreover, it is also not convenient to store and show the gun on a stand. In addition, a trigger guard ring is usually designed at an outer circle around the trigger to protect the trigger.

Therefore, how to provide a lock for safety protection of a gun trigger and a multifunctional gun storage stand, so as to provide showable safe storage for portable guns that can be displayed, to achieve convenient and fast unlocking, and to facilitate use, is a technical problem needing to be solved.

SUMMARY

In order to overcome the drawbacks described above, the present disclosure aims to provide a technical solution capable of solving the above problems.

The present disclosure provides a lock for a gun, including a base, a shell fixedly connected to the base, a stabilizer fixedly connected to the shell, and a locking device mounted inside the shell. The locking device includes a movably opened and closed lock catch assembly and a locking assembly restraining the lock catch assembly from being movably opened and closed; the lock catch assembly is movably connected to the locking assembly, and the lock catch assembly includes a lock catch column; and one end of the lock catch column is movably connected to the lock catch assembly, and the other end of the lock catch column extends into the stabilizer to lock and fix a trigger guard ring of a gun placed on the stabilizer, thereby restraining use of the gun together with the stabilizer.

In a further solution of the present disclosure, one end of the lock catch post extending into the stabilizer includes a latch hook; and the latch hook limits and locks the trigger guard ring of the gun, thereby forming the safety protection for the gun trigger.

In a further solution of the present disclosure, the lock catch assembly includes a lock beam, a U-shaped seat, and a support column; one end of the lock beam is movably connected to the locking assembly, and the other end of the lock beam is fixedly connected to the U-shaped seat; the support column is connected to the U-shaped seat, passes through two side walls of the U-shaped seat, and protrudes out of the side walls by a certain distance; and one end of the lock catch post movably connected to the lock catch assembly sleeves the support column, thereby rotating around the support column for opening and closing.

In a further solution of the present disclosure, the lock catch post includes a first lock post and a second lock post respectively sleeving the support column; the lock catch assembly includes a torsion spring; the torsion spring sleeves the support column; one end of the torsion spring resists against the first lock post, and the other end of the torsion spring resists against the second lock post; a torsion force of the torsion spring keeps the first lock post and the second lock post in an open state of being away from each other; a sliding convex bar is arranged on a side wall, opposite to an opening direction of the lock catch post, on the locking assembly; a sliding groove is arranged on one side of the lock catch post opposite to the sliding convex bar; the sliding convex bar and the sliding groove cooperate with each other to enable the lock catch post to slide on a side wall of the locking assembly; and when the lock catch assembly moves into the locking assembly, the side wall of the locking assembly provided with the sliding convex bar forms a limiting barrier on the lock catch post, causing the first lock post and the second lock post to rotate towards each other to form a locked state.

In a further solution of the present disclosure, the lock catch assembly includes an unlocking spring and a limiting clamp; the unlocking spring sleeves the lock beam; one end of the unlocking spring resists against the locking assembly, and the other end of the unlocking spring resists against the lock catch assembly; an elastic force of the unlocking spring causes the lock catch assembly to move towards the outside of the locking assembly; the limiting clamp is fixedly connected to a tail of one end of the lock beam movably connected to the locking assembly; and the limiting clamp is configured to limit a distance that the lock catch assembly moves towards the outside of the locking assembly.

In a further solution of the present disclosure, the locking assembly includes a lock hole, a spring bolt, and a locking spring; the spring bolt is movably connected to the locking assembly; the lock beam is in locking connection with the spring bolt through the lock hole; one end of the locking spring resists against the locking assembly, and the other end of the locking spring resists against the spring bolt; and an elastic force of the locking spring causes the spring bolt to cooperate with the lock beam to maintain a locked state.

In a further solution of the present disclosure, the lock catch assembly includes a manual pressing piece; the manual pressing piece is movably connected to the shell; one end of the manual pressing piece extends into the shell and includes a pressing groove, and the other end of the manual pressing piece extends out of the shell and includes a hand-pressing slider; the pressing groove respectively resists against two ends of the support column protruding out of side walls; the pressing groove of the manual pressing piece drives the lock catch assembly to be synchronously pressed by pulling the hand-pressing slider, so that the spring bolt and the lock beam cooperate with each other to form a locked state; and the lock catch post of the lock catch assembly locks and fixes the trigger guard ring of the gun.

In a further solution of the present disclosure, the locking device includes a mechanical lock and a mechanical cam; the mechanical lock is fixedly connected to the shell, and the mechanical cam is fixedly connected to a rotating shaft of the mechanical lock; and when the mechanical lock is unlocked by an external key, the key is turned to cause the rotating shaft to synchronously rotate and drive the mechanical cam to rotate, thereby pushing the spring bolt to move a certain distance away from the lock beam to form an unlocked state.

In a further solution of the present disclosure, the locking device includes an electronic unlocking device; the electronic unlocking device includes a reduction motor, an electric cam, a touch switch, a circuit board, a control chip, a power assembly, and a power inputting assembly; the reduction motor, the touch switch, and the circuit board are fixedly connected to the locking assembly respectively; the electric cam is fixedly connected to a rotating shaft of the reduction motor; the control chip and the power assembly are fixedly connected to the circuit board; the touch switch and the power inputting assembly are electrically connected to the control chip; the power inputting assembly sends an unlocking signal to the control chip when receiving a correct preset password; after receiving the unlocking signal, the control chip controls the reduction motor to rotate, thus driving the electric cam to rotate synchronously and then pushing the spring bolt to move a certain distance away from the lock beam to form an unlocked state; when the spring bolt moves a certain distance and resists against the touch switch, the touch switch sends a rotation stop signal to the control chip; and the control chip controls, after receiving the rotation stop signal, the reduction motor to stop rotating.

In a further solution of the present disclosure, the electronic unlocking device includes a fingerprint recognition assembly; the fingerprint recognition assembly is electrically connected to the control chip; the fingerprint recognition assembly sends an unlocking signal to the control chip when recognizing and receiving a correct preset fingerprint; and after receiving the unlocking signal, the control chip controls the reduction motor to rotate, thus driving the electric cam to rotate synchronously and then pushing the spring bolt to move a certain distance away from the lock beam to form an unlocked state.

The present disclosure further provides a multifunctional gun storage stand, including the lock for the safety protection of the gun trigger described above, further including a stand body, wherein the stand body includes a lock fixing seat, a placement frame, a stacking frame, a card holder slot, and a storage slot; the base includes a buckle groove; and the buckle groove is configured to be buckled on the lock fixing seat, so that the lock for the safety protection of the gun trigger is fixedly connected to the storage stand to form vertical and stable placement and storage.

Compared with the prior art, the present disclosure has the beneficial effects below:

1. By the arrangement of the lock catch post that extends into the stabilizer, the trigger guard ring can be locked and fixed, thereby forming safety protection locking for the gun together with the stabilizer. Furthermore, unlocking is fast. After correct unlocking, the lock catch post is automatically separated to both sides, and the gun can be immediately taken down.
2. The buckle groove is arranged on the base, so that it is convenient to fix the lock to an external device to form a vertical stand style that can safely store a showable gun.
3. The lock catch post includes the latch hook, and the latch hook passes through the trigger guard ring to achieve locking; and by use of the limiting effect of the stabilizer, the safety protection of the gun trigger is achieved.
4. Multiple unlocking manners are set, especially the introduction of a fingerprint unlocking manner, which further improves the speed of unlocking.

In summary, through the improvement described above on the present disclosure, the lock for the safety protection of the gun trigger and the multifunctional gun storage stand can be provided, so as to provide showable safe storage for portable guns that can be displayed, to achieve convenient and fast unlocking, and to facilitate use.

The additional aspects and advantages of the present disclosure will be partially provided in the following descriptions, some of which will become apparent from the following descriptions, or learned through the practice of the present disclosure.

BRIEF DESCRIPTION OF THE DRAWINGS

To describe the technical solutions in the embodiments of the present disclosure or in the prior art more clearly, the following briefly introduces the accompanying drawings for describing the embodiments or the related art. Apparently, the accompanying drawings in the following description show merely some embodiments of the present disclosure, and a person of ordinary skill in the art may still derive other drawings from the accompanying drawings without creative efforts.

Figure 1:
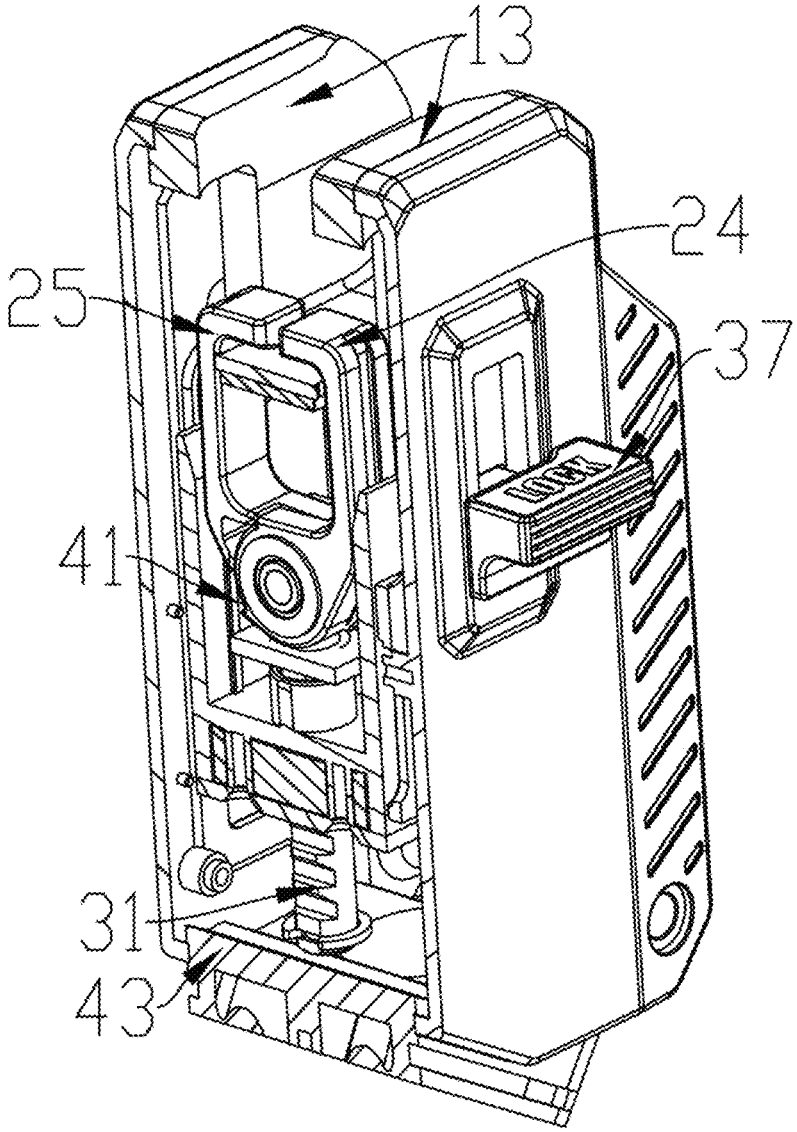
FIG. 1 is a schematic sectional view of a locked state of the present disclosure.

Reference numerals and names in the drawings are as follows:

10: base; 11: buckle groove; 12: shell; 13: stabilizer; 14: metal seat; 15: locking device; 20: lock catch assembly; 21: torsion spring; 22: lock catch post; 23: latch hook; 24: first lock post; 25: second lock post; 26: sliding groove; 31: lock beam; 32: U-shaped seat; 33: support column; 34: unlocking spring; 35: limiting clamp; 36: manual pressing piece; 37: hand-pressing slider; 38: pressing groove; 40: locking assembly; 41: sliding convex bar; 42: lock hole; 43: spring bolt; 44: locking spring; 45: mechanical lock; 46: mechanical cam; 50: electronic unlocking device; 51: reduction motor; 52: electric cam; 53: touch switch; 54: circuit board; 55: power assembly; 56: charging interface; 57: password inputting assembly; 58: fingerprint recognition assembly; 61: setting button; 62: ADD button; 63: RES button; 70: stand body; 71: lock fixing seat; 72: placement frame; 73: stacking frame; 74: card holder slot; and 75: storage slot.

DETAILED DESCRIPTION OF THE EMBODIMENTS

The technical solutions in the embodiments of the present disclosure are clearly and completely described below. Apparently, the described embodiments are merely some embodiments of the present disclosure, rather than all of the embodiments. All other embodiments obtained by a person of ordinary skill in the art based on the embodiments of the present disclosure without making creative efforts shall fall within the protection scope of the present disclosure.

Referring to FIG. 1 to FIG. 12, in the embodiments of the present disclosure, a lock for a gun includes a base 10, a shell 12 fixedly connected to the base 10, a stabilizer 13 fixedly connected to the shell 12, and a locking device 15 mounted inside the shell 12; the locking device 15 includes a movably opened and closed lock catch assembly 20 and a locking assembly 40 restraining the lock catch assembly 20 from being movably opened and closed; the lock catch assembly 20 is movably connected to the locking assembly 40, and the lock catch assembly 20 includes a lock catch post 22; and one end of the lock catch post 22 extends into the stabilizer 13 to lock and fix a trigger guard ring of a gun when the gun is placed on the stabilizer 13, thereby restraining use of the gun together with the stabilizer 13. The buckle groove 11 is arranged on the base 10, and the buckle groove 11 is configured to be buckled and connected to an external device, so that the lock is fixedly connected to the external device to form a vertical stand configured to vertically support the gun. One end of the lock catch post 22 extending into the stabilizer 13 includes a latch hook 23; and the latch hook 23 limits and locks a trigger guard ring of a gun, thereby forming the safety protection for the gun trigger.

Specifically, in order to store and show a gun in an indoor office environment, a stand needs to be provided. However, if it is only a simple stand, the stand cannot provide safety protection for the gun. Therefore, a stand type lock for a gun is arranged. The gun can be locked on a lock body, or the gun can be visually protected and showed by buckling a lock body into the external device, for example, on an external tabletop or a metal display shelf. Preferably, the stabilizer 13 can be configured in various shapes and appearances to match different gun sizes on the market. In addition, a portion of the stabilizer 13 contacting the gun can be made of a soft material, such as silica gel, and a position where the stabilizer 13 is fixed to the shell 12 is preferably a metal seat 14, thereby increasing the strength of the fixed connection between the stabilizer 13 and the lock body itself and further improving the safety of the gun after the gun is locked.

In addition, in order to facilitate locking of the trigger guard ring of the gun by the lock body, it is preferred to arrange a latch hook 23 at one end of the lock catch post 22 that locks the trigger guard ring, so that the trigger guard ring can be hooked and the position of the trigger guard ring can be fixed firmly at a specific position of the stabilizer 13. Thus, the gun will not shake, and the trigger will not be driven, thereby improving the safety of the gun during storage.

As shown in FIG. 5 to FIG. 9, preferably, the lock catch assembly 20 includes a lock beam 31, a U-shaped seat 32, and a support column 33; one end of the lock beam 31 is movably connected to the locking assembly 40, and the other end of the lock beam 31 is fixedly connected to the U-shaped seat 32; the support column 33 is fixedly connected to the U-shaped seat 32, passes through two side walls of the U-shaped seat 32, and protrudes out of the side walls by a certain distance; and one end of the lock catch post 22 movably connected to the lock catch assembly 20 sleeves the support column 33, thereby rotating around the support column 33 for opening and closing. The lock catch post 22 includes a first lock post 24 and a second lock post 25 respectively sleeving the support column 33; the lock catch assembly 20 includes a torsion spring 21; the torsion spring 21 sleeves the support column 33; one end of the torsion spring 21 resists against the first lock post 24, and the other end of the torsion spring 21 resists against the second lock post 25; and a torsion force of the torsion spring 21 keeps the first lock post 24 and the second lock post 25 in an open state wherein the first lock post 24 and the second lock post 25 are away from each other. A sliding convex bar 41 is arranged on a side wall of the locking assembly 40, opposite to an opening direction of the lock catch post 22; a sliding groove 26 is arranged on one side of the lock catch post 22 opposite to the sliding convex bar 41; the sliding convex bar 41 and the sliding groove 26 cooperate with each other to enable the lock catch post 22 to slide on a side wall of the locking assembly 40; and when the lock catch assembly 20 moves into the locking assembly 40, the side wall of the locking assembly 40 defining the sliding convex bar 41 forms a limiting barrier on the lock catch post 22, causing the first lock post 24 and the second lock post 25 to rotate towards each other to form a locked state of the lock catch post.

Specifically, one end of the lock beam 31 extends into the locking assembly 40 and is fixedly connected by the spring bolt 43 of the locking assembly 40 in a separable manner, thereby forming the locked state. The other end of the lock beam 31 is fixed to the U-shaped seat 32, and the support column 33 passes through the side walls of the U-shaped seat 32 and is fixedly connected to the side walls of the U-shaped seat 32. When a hand-pressing slider 37 is pressed down to slide, a pressing groove 38 can drive the support column 33 to synchronously slide down, which also drives the U-shaped seat 32 and the lock beam 31 to synchronously move downwards, so as to form a locked connection of the lock beam 31 with the spring bolt 43. In order to achieve the locking of the trigger guard ring, the first lock post 24 and the second lock post 25 which sleeve the support column 33 are configured, and the torsion spring 21 is also configured to keep the first lock post 24 and the second lock post 25 in the open state at the beginning. Only when the manual pressing piece 36 is pressed, the first lock post 24 and the second lock post 25 rotate a certain angle towards the middle under the restriction of the sliding convex bar 41 of the locking assembly 40. Thus, the latch hooks 23 rotate towards each other to lock and fix the trigger guard ring and then safely lock the gun.

Figure 2:
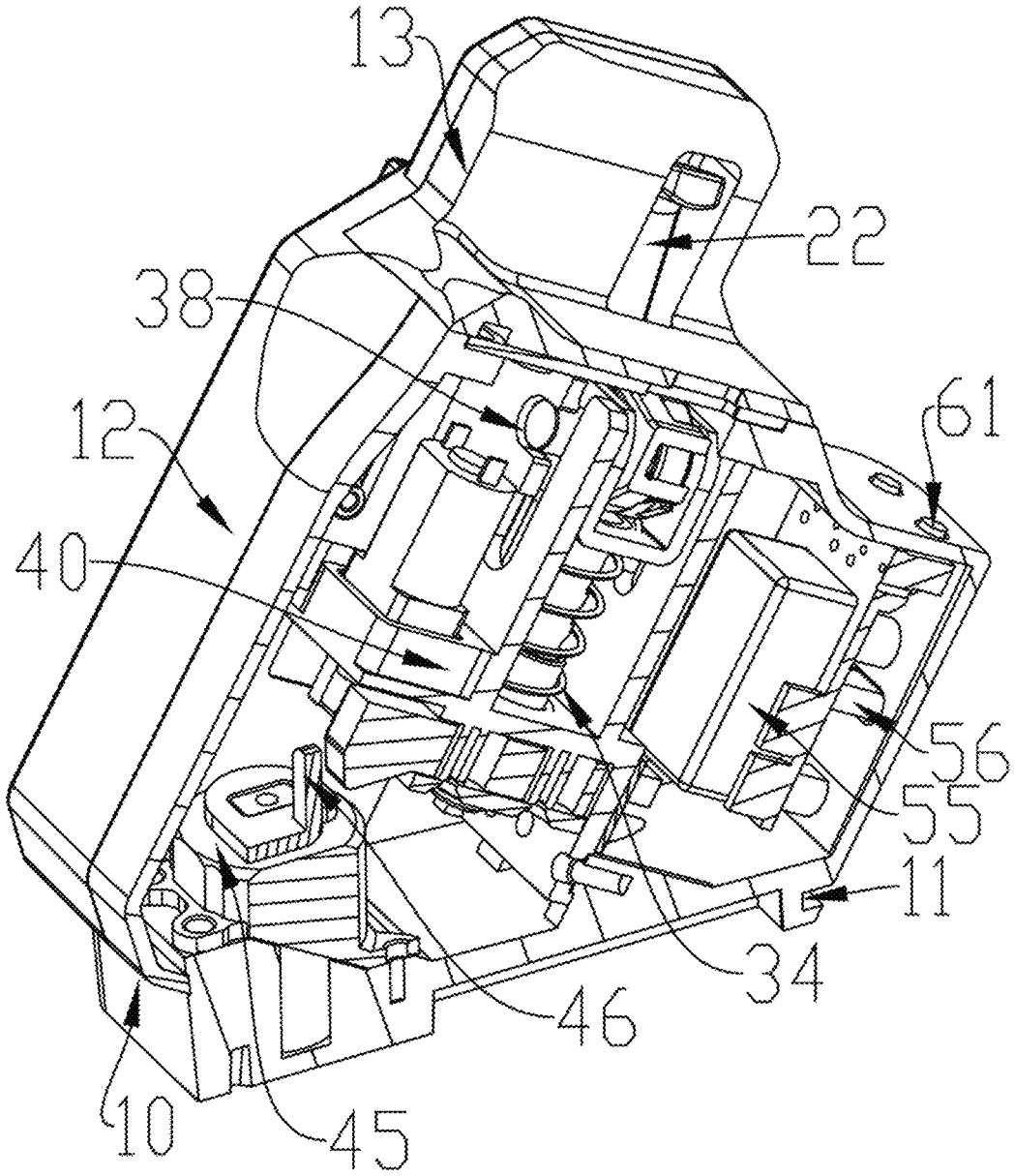
FIG. 2 is a schematic structural diagram of a pressing groove of the present disclosure.
Figure 3:
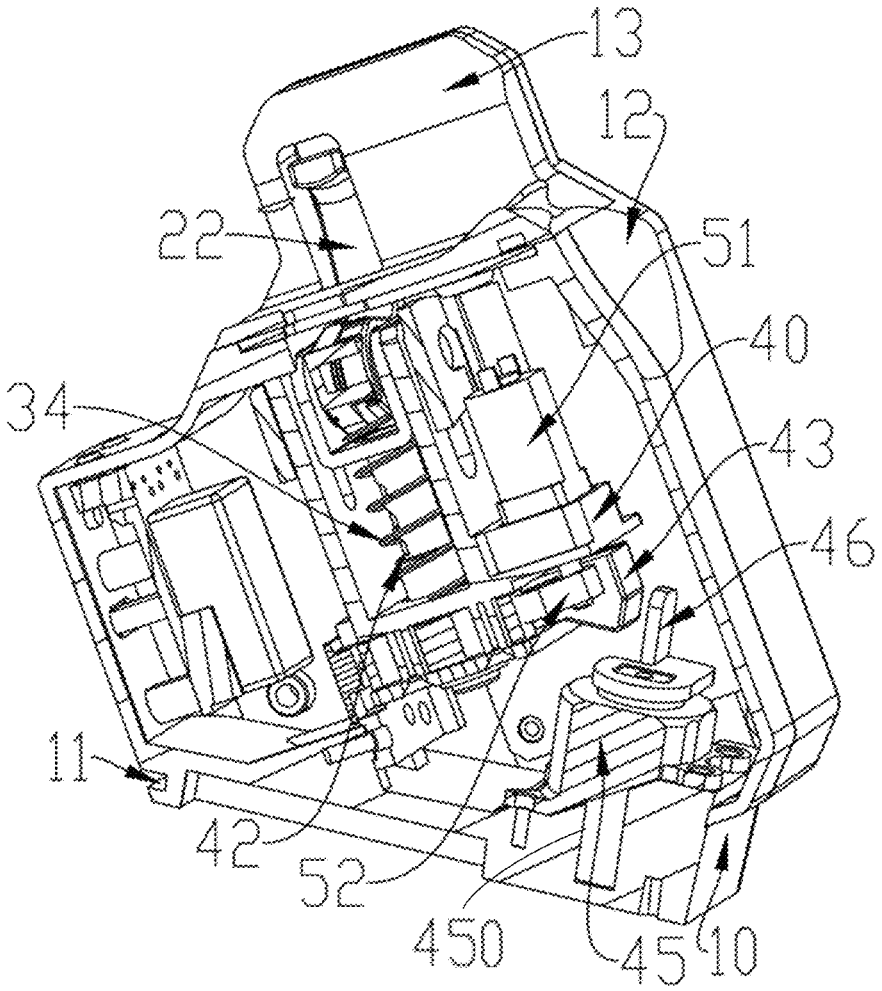
FIG. 3 is a schematic structural diagram of an unlocking spring of the present disclosure.
Figure 5:
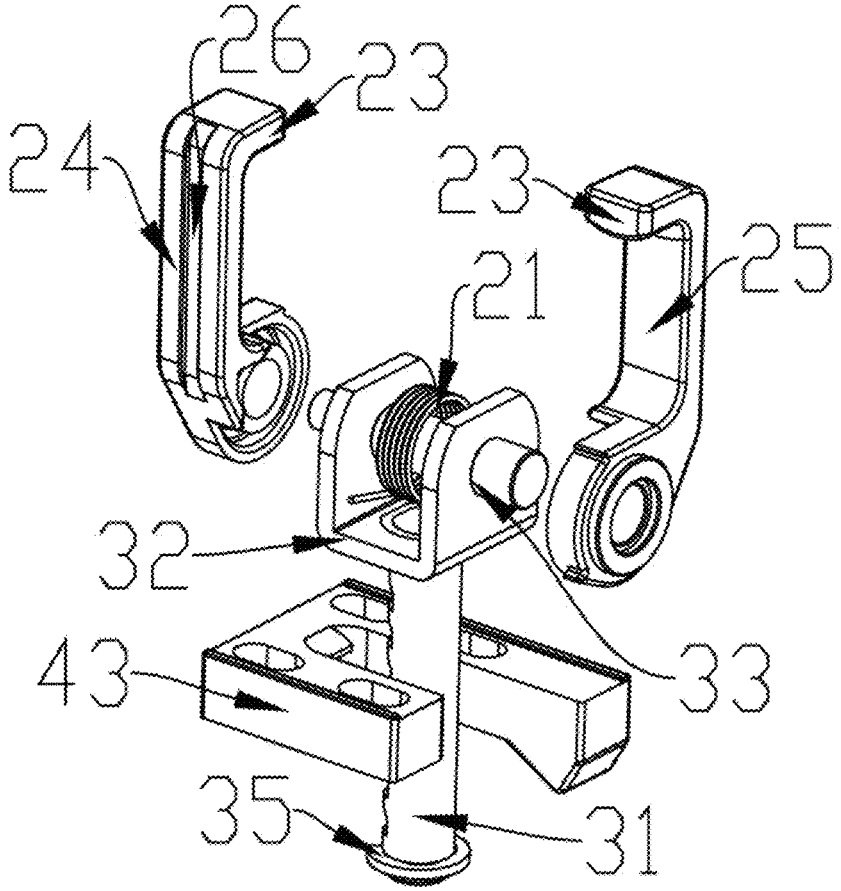
FIG. 5 is an exploded structural diagram of a lock catch assembly of the present disclosure.

As shown in FIG. 2, FIG. 3, and FIG. 5, preferably, the lock catch assembly 20 includes an unlocking spring 34 and a limiting clamp 35; the unlocking spring 34 sleeves the lock beam 31; one end of the unlocking spring 34 resists against the locking assembly 40, and the other end of the unlocking spring 34 resists against the U-shaped seat 32; an elastic force of the unlocking spring 34 causes the lock catch assembly 20 to move towards the outside of the locking assembly 40; the limiting clamp 35 is fixedly connected to a tail of one end of the lock beam 31 movably connected to the locking assembly 40; and the limiting clamp 35 is configured to limit a distance that the lock catch assembly 20 moves towards the outside of the locking assembly 40.

Specifically, due to the action of the torsion spring 21, the lock catch post 22 maintains the open state, so that the unlocking spring 34 is configured, which is mainly configured to push the lock catch assembly 20 out towards the stabilizer 13 to keep the lock catch post 22 in its initial open state. It can be understood that in this setting, after a user unlocks the lock, the spring bolt 43 is pushed away from the lock beam 31, thereby releasing the limiting effect on the lock beam 31. Therefore, the lock catch assembly 20 can quickly rebound to the initial state under the action of the elastic force of the unlocking spring 34, thus achieving the effect of quickly unlocking the gun and allowing the user to quickly use the gun protected and stored on the stand.

Figure 6:
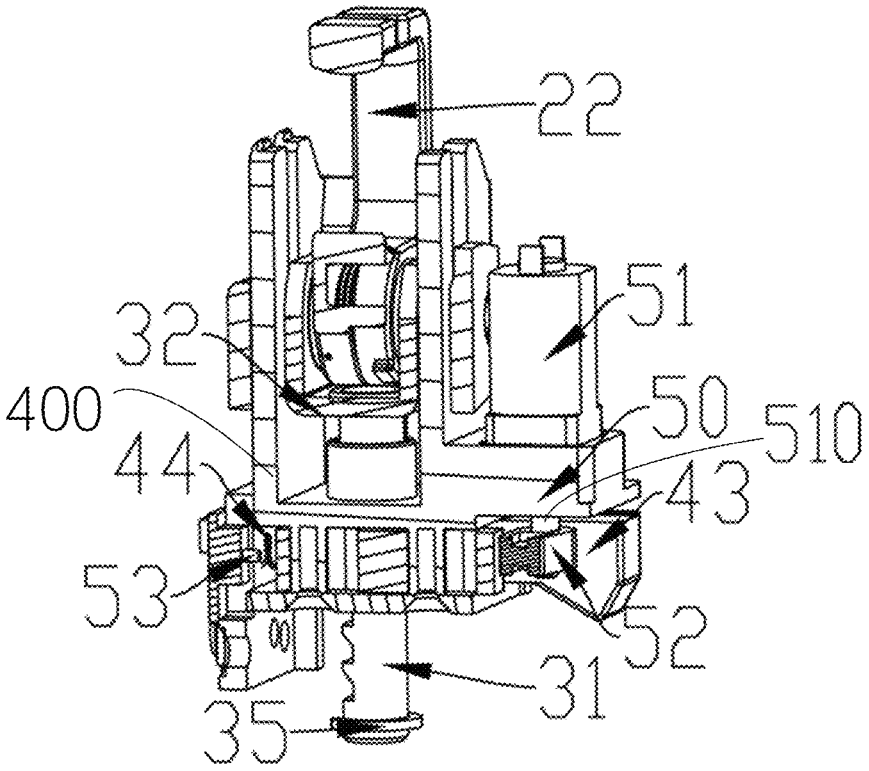
FIG. 6 is a schematic structural diagram of an electronic unlocking device of the present disclosure.

As shown in FIG. 3 and FIG. 6, preferably, the locking assembly 40 includes a main body 400, a lock hole 42, a spring bolt 43, and a locking spring 44; the spring bolt 43 is movably connected to the main body 400; the lock beam 31 is in locking connection with the spring bolt 43 through the lock hole 42; one end of the locking spring 44 resists against the main body 400, and the other end of the locking spring 44 resists against the spring bolt 43; and an elastic force of the locking spring 44 causes the spring bolt 43 to cooperate with the lock beam 31 to maintain a locked state of the locking assembly 40.

Specifically, in order to quickly form latching connection between the spring bolt 43 and the lock beam 31 after the user presses a manual pressing piece 36 to press the lock catch assembly 20, the locking spring 44 is configured. The elastic force of the locking spring 44 can act on the spring bolt 43, so that the spring bolt 43 remains being connected to a lock catch of the lock beam 31. When a mechanical cam 46 or an electric cam 52 of the locking assembly 40 rotates and pushes the spring bolt 43 towards a direction away from the lock beam 31, the locking spring 44 is compressed to achieve an unlocking function.

Figure 7:
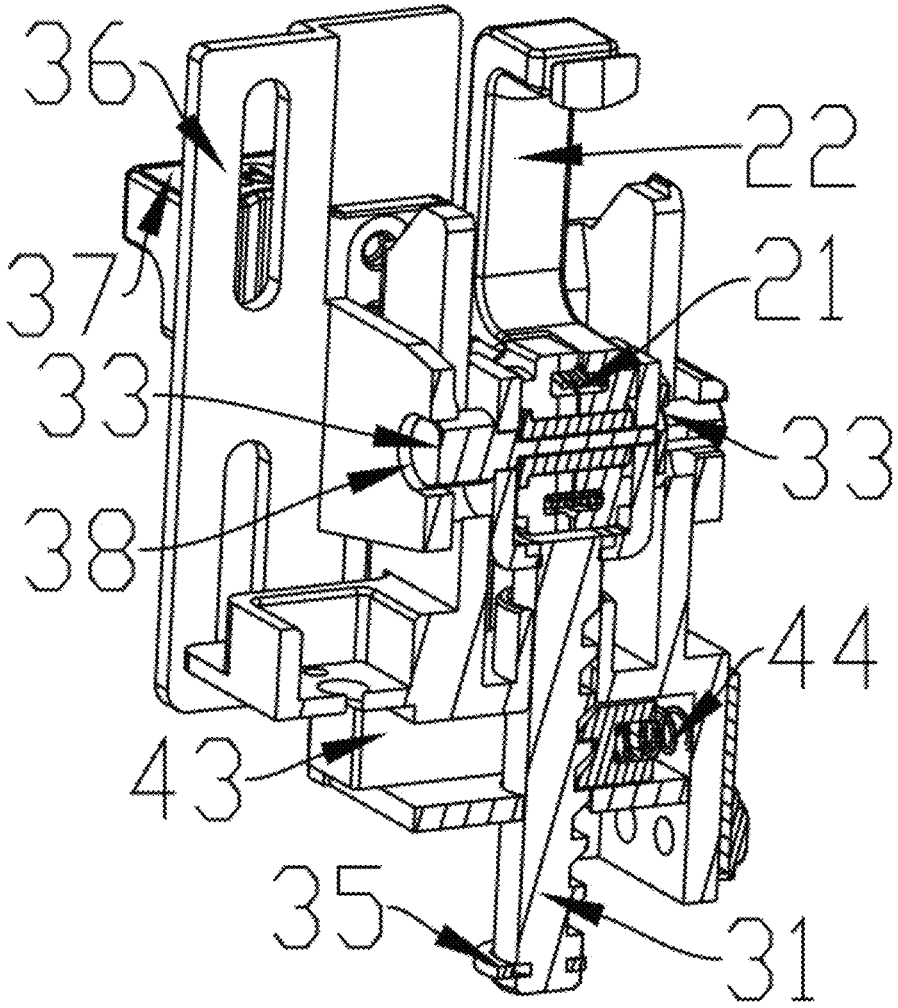
FIG. 7 is a schematic structural diagram of a locking spring of the present disclosure.
Figure 8:
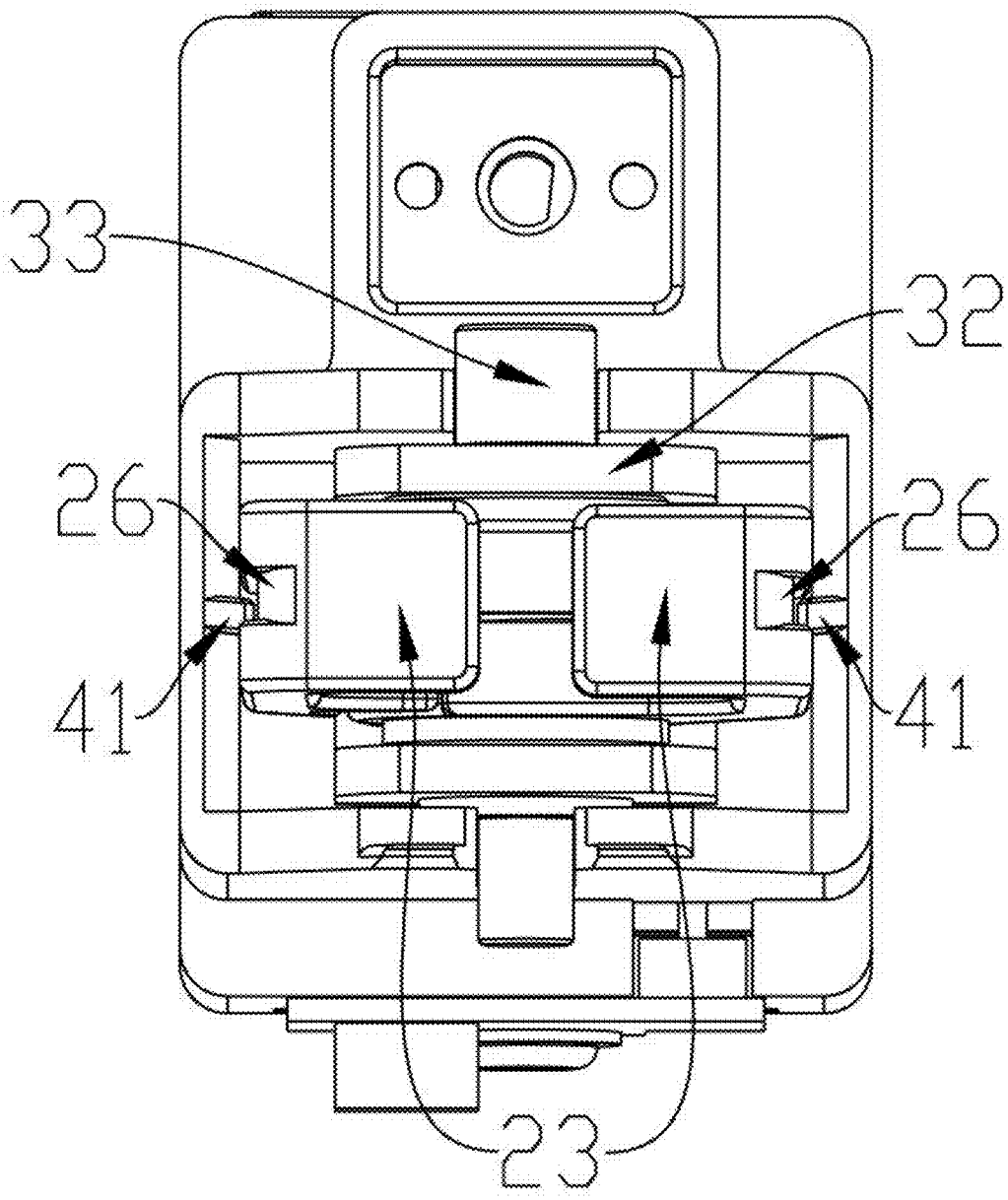
FIG. 8 is a schematic structural diagram of a sliding groove and a sliding convex bar of the present disclosure.
Figure 9:
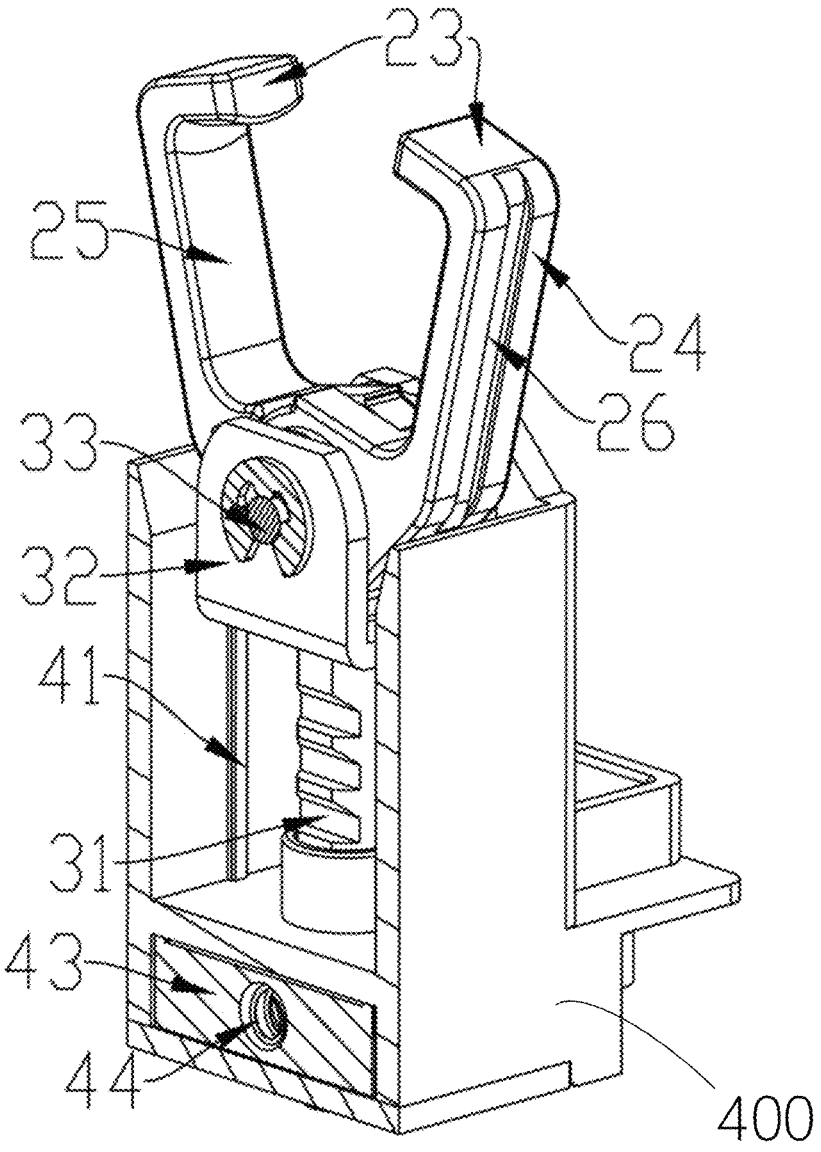
FIG. 9 is a schematic sectional view of an opened state of a lock catch post of the present disclosure.
Figure 10:
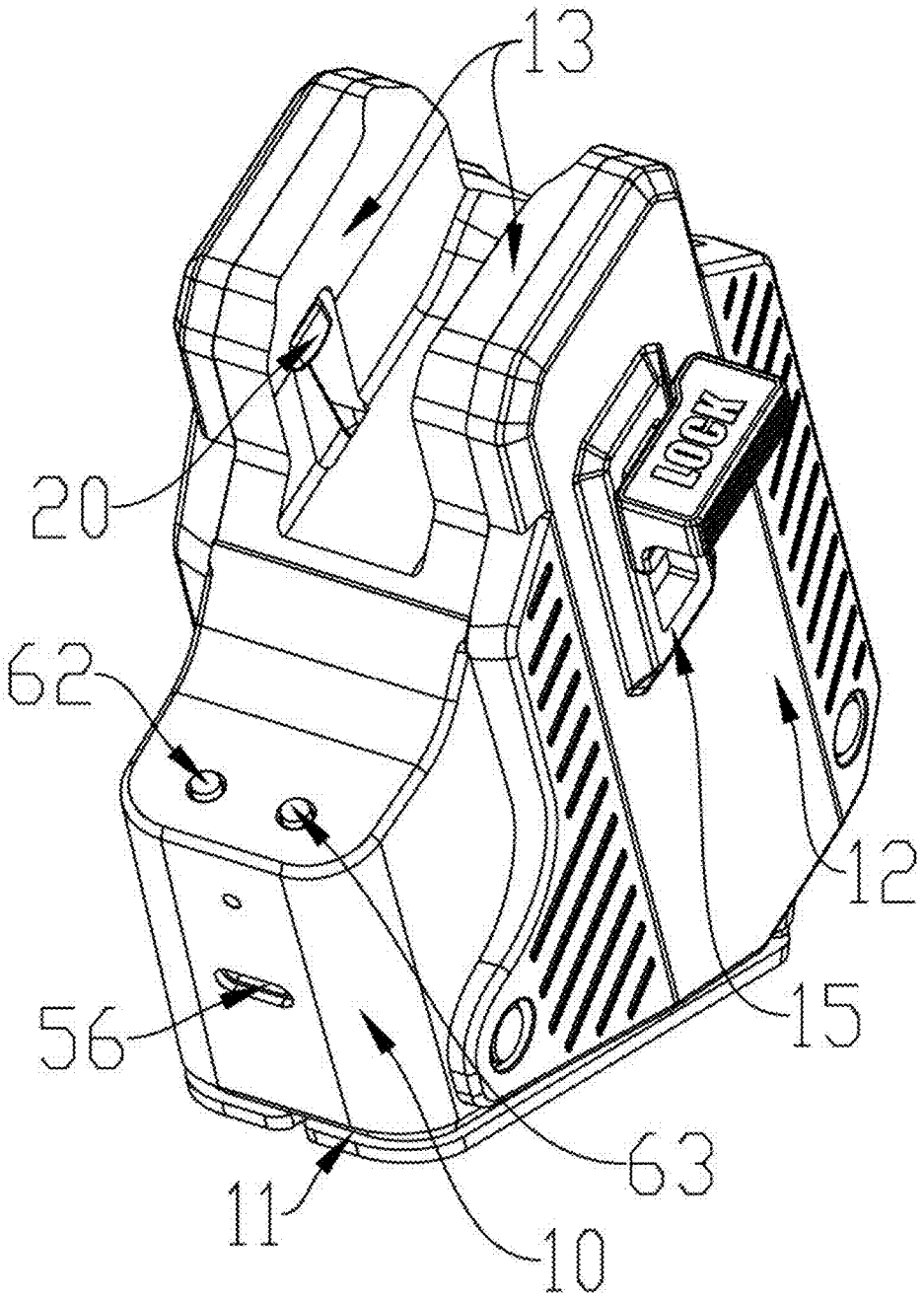
FIG. 10 is a schematic structural diagram of a lock of the present disclosure.
Figure 11:
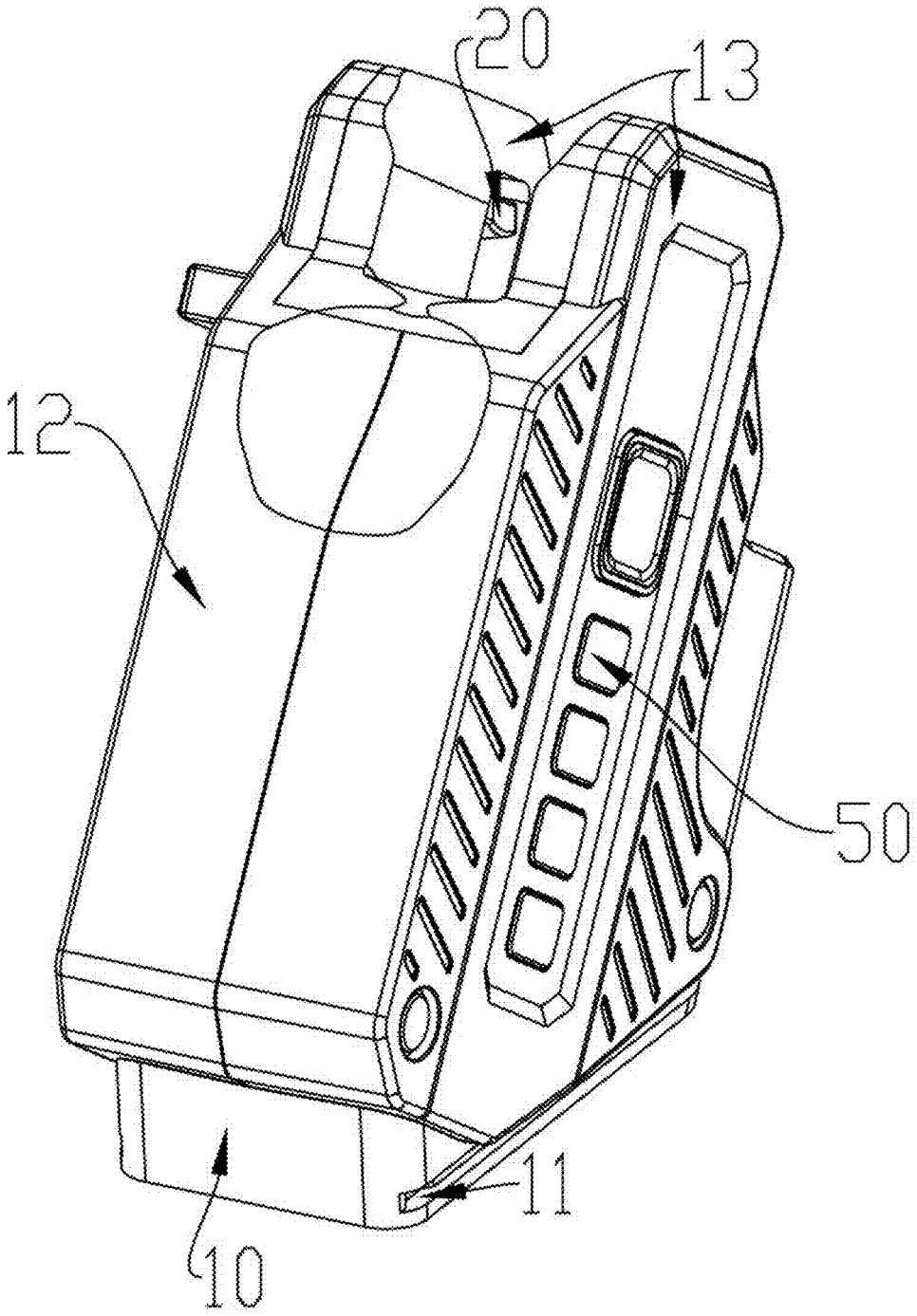
FIG. 11 is a schematic structural diagram of a lock of the present disclosure in another angle.

As shown in FIG. 7, preferably, the lock catch assembly 20 includes the manual pressing piece 36; the manual pressing piece 36 is movably connected to the shell 12; one end of the manual pressing piece 36 extends into the shell 12 and includes a pressing groove 38, and the other end of the manual pressing piece extends out of the shell 12 and includes a hand-pressing slider 37; the pressing groove 38 respectively resists against two ends of the support column 33 protruding out of side walls; the pressing groove 38 of the manual pressing piece 36 drives the lock catch assembly 20 to be synchronously pressed by pulling the hand-pressing slider 37, so that the spring bolt 43 and the lock beam 31 cooperate with each other to form a locked state; and the lock catch post 22 of the lock catch assembly 20 locks and fixes the trigger guard ring of the gun.

Specifically, manual pressing is required for locking, but unlocking can be achieved without a manual operation: The lock is directly popped up by using the elastic force, which can accelerate the unlocking speed. This allows the user to quickly unlock the gun and pick up the gun to do corresponding actions.

As shown in FIG. 3, preferably, the locking device 15 includes a mechanical lock 45 and the mechanical cam 46; the mechanical lock 45 is fixedly connected to the shell 12, and the mechanical cam 46 is fixedly connected to a rotating shaft of the mechanical lock 45; and when the mechanical lock 45 is unlocked by an external key, the key is turned to cause the rotating shaft to synchronously rotate and drive the mechanical cam 46 to rotate, thereby pushing the spring bolt 43 to move a certain distance away from the lock beam 31 to form an unlocked state.

Specifically, the lock hole 42 of the mechanical lock 45 can be arranged at a bottom of the base 10, so that when the lock body is mounted on the external device, the lock hole 42 can be hidden, which further improves the safety. In addition, a certain bulge can also be arranged on the spring bolt 43, which facilitates the mechanical cam 46 to better push the spring bolt 43 away from the position of the lock beam 31 during rotation, thereby achieving the unlocking operation.

Figure 4:
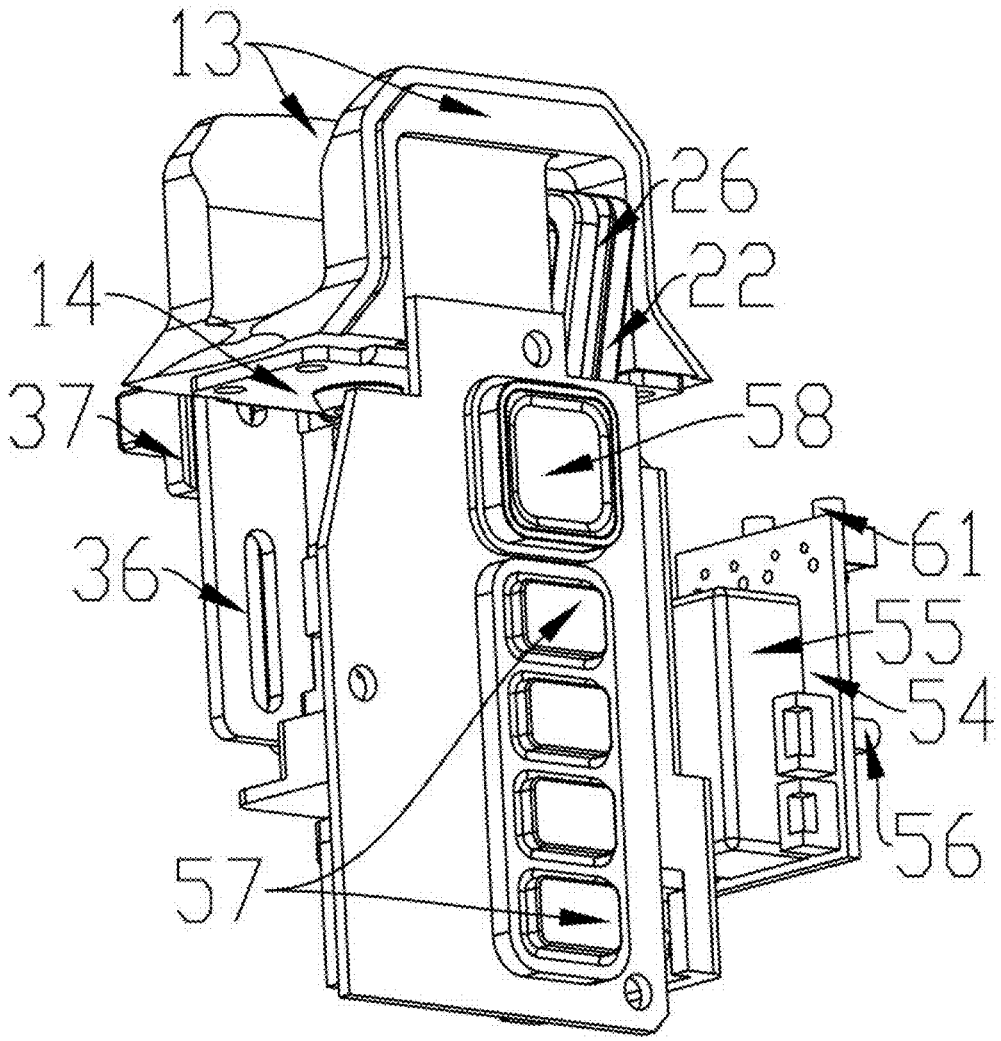
FIG. 4 is a schematic structural diagram of a metal seat of the present disclosure.

As shown in FIG. 4 and FIG. 6, preferably, the locking device 15 includes an electronic unlocking device 50; the electronic unlocking device 50 includes a reduction motor 51, the electric cam 52, a touch switch 53, a circuit board 54, a control chip (not shown), a power assembly 55, and a power inputting assembly 57; the reduction motor 51, the touch switch 53, and the circuit board 54 are fixedly connected to the locking assembly 40 respectively; the electric cam 52 is fixedly connected to a rotating shaft of the reduction motor 51; the control chip and the power assembly 55 are fixedly connected to the circuit board 54; the touch switch 53 and the power inputting assembly 57 are electrically connected to the control chip; the power inputting assembly 57 sends an unlocking signal to the control chip when receiving a correct preset password; after receiving the unlocking signal, the control chip controls the reduction motor 51 to rotate, thus driving the electric cam 52 to rotate synchronously and then pushing the spring bolt 43 to move a certain distance away from the lock beam 31 to form an unlocked state; when the spring bolt 43 moves a certain distance and resists against the touch switch 53, the touch switch 53 sends a rotation stop signal to the control chip; and the control chip controls, after receiving the rotation stop signal, the reduction motor 51 to stop rotating.

Specifically, the reduction motor 51 can be a stepping motor or an ordinary motor with a reduction gear, which can provide a certain rotating torque to push the spring bolt 43 away from the lock beam 31, thereby achieving the unlocking operation. The electric cam 52 and the mechanical cam 46 can push the same bulge on the spring bolt 43, or two different bulges are arranged on the spring bolt 43, so that the electric cam 52 and the mechanical cam 46 respectively push the different bulges, and the spring bolt 43 can be pushed to move. In addition, the corresponding touch switch 53 can be arranged on the locking assembly 40. When the spring bolt 43 is driven by the electric cam 52 to move a certain distance, the spring bolt 43 resists against the touch switch 53, so that the touch switch 53 sends a running stop signal to the control chip. After receiving the running stop signal, the control chip controls the reduction motor 51 to stop rotating. It can be understood that the control chip is also internally provided with a corresponding driver module or driver program of the reduction motor 51. After unlocking, the reduction motor 51 is powered off and loses its rotation force. The spring bolt 43 is pushed back to its original locking position by the elastic force of the unlocking spring 34. Preferably, the elastic force of the unlocking spring can also be used to push the electric cam 52 to anticlockwise rotate a certain angle to the initial position of the electric cam. Of course, the control chip can also be used to control the reduction motor 51 to anticlockwise rotate for certain time, thereby restoring the electric cam 52 to its initial position.

Secondly, the power assembly 55 can further include a battery (not shown in the figure) and a charging interface 56. The battery is preferably a rechargeable battery, and the charging interface 56 is configured to charge the battery. The control chip can further include an existing program or module in the prior art to achieve battery charging and discharging management. The battery is configured to supply power to electronic elements inside the lock body. The password inputting assembly 57 can include a plurality of password inputting buttons for password setting and inputting. It can be understood that the control chip can further include a password presetting program and a password comparison program to manage and compare a password entered by the user. When the input password is correct, the reduction motor 51 can be driven to rotate to achieve unlocking.

In addition, in order to facilitate password setting and management, button 61 can also be mounted on the circuit board 54, such as an ADD button 62 and a RES button 63. The ADD button 62 is configured to add passwords or fingerprints and the like, and the RES button 63 is configured to confirm inputting. An operation manner of the buttons can use the existing operation manner in the prior art, and will not be described in detail here.

As shown in FIG. 4, preferably, the electronic unlocking device 50 includes a fingerprint recognition assembly 58; the fingerprint recognition assembly 58 is electrically connected to the control chip; the fingerprint recognition assembly 58 sends an unlocking signal to the control chip when recognizing and receiving a correct preset fingerprint; and after receiving the unlocking signal, the control chip controls the reduction motor 51 to rotate, thus driving the electric cam 52 to rotate synchronously and then pushing the spring bolt 43 to move a certain distance away from the lock beam 31 to form an unlocked state. After the spring bolt 43 moves a certain distance and resists against the touch switch 53, the touch switch 53 sends a rotation stop signal to the control chip. The control chip controls, after receiving the rotation stop signal, the reduction motor 51 to stop rotating.

Specifically, the fingerprint recognition assembly 58 can use the existing product in the prior art and pre-input a corresponding control program or control module into the control chip to drive the fingerprint recognition assembly 58 to input and compare fingerprints. After inputting a correct fingerprint, the control chip can control the reduction motor 51 to perform a corresponding unlocking operation. In addition, preferably, the fingerprint recognition assembly 58 and the password inputting assembly 57 can also be arranged on the separate circuit board 54 and are electrically connected to the control chip.

Figure 12:
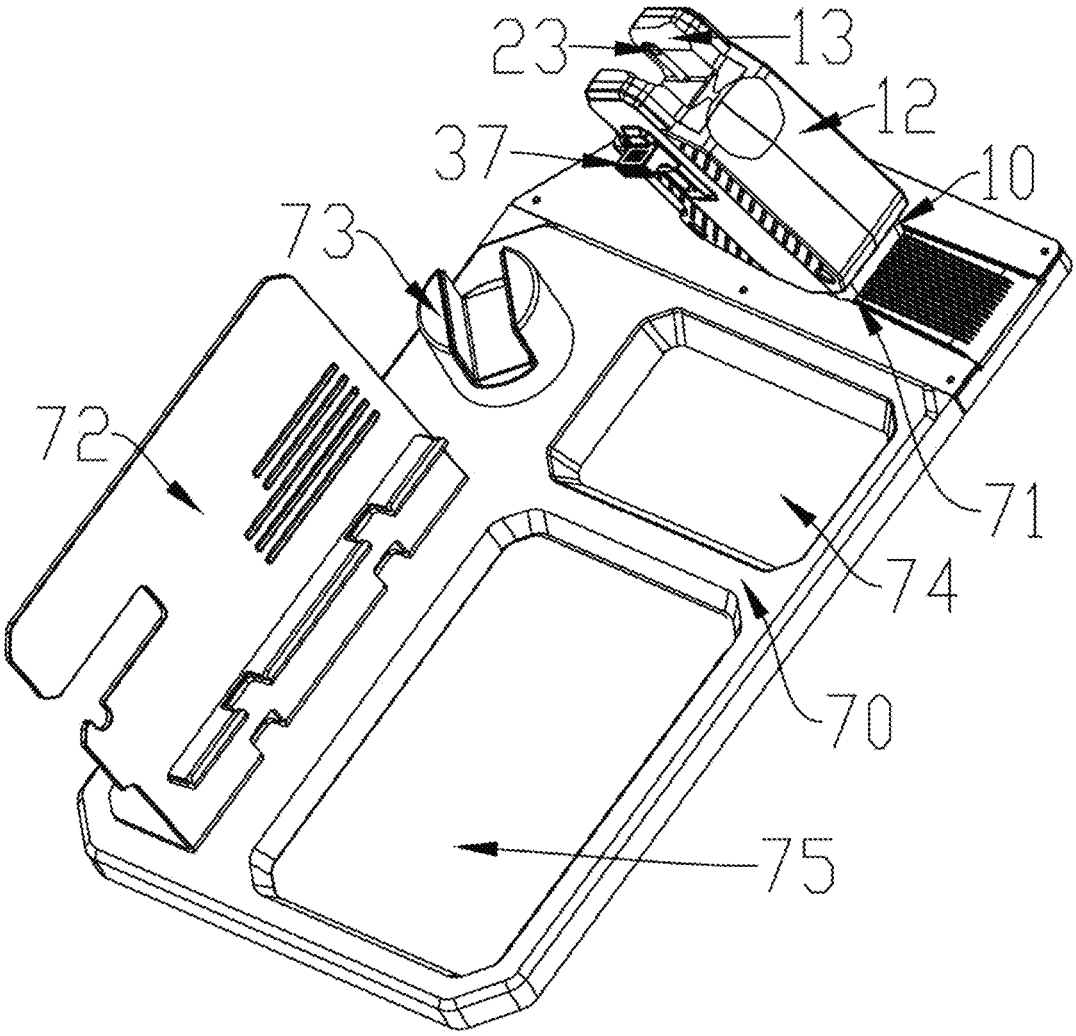
FIG. 12 is a schematic structural diagram of a stand body of the present disclosure.

As shown in FIG. 12, the present disclosure further provides a multifunctional gun storage stand, including the lock for the safety protection of the gun trigger described above, further including a stand body 70, wherein the stand body 70 includes a lock fixing seat 71, a placement frame 72, a stacking frame 73, a card holder slot 74, and a storage slot 75; the base 10 includes a buckle groove 11; and the buckle groove 11 is configured to be buckled on the lock fixing seat 71, so that the lock for the safety protection of the gun trigger is fixedly connected to the storage stand to form vertical and stable placement and storage.

Specifically, in order to further place the lock, a corresponding multifunctional gun storage stand can be configured and is locked to the lock fixing seat 71, which is convenient for placement and can also form a vertical storage state to show the gun. In addition, the storage stand can further include the placement frame 72 for placing a mobile phone or another object. The storage stand can further include the stacking frame 73 with certain grooves to place a watch or another object. The storage tank can further include the card holder slot 74 for placing a card holder or another object. The storage stand can further include the storage slot 75 for placing another object that is easy to roll.

During use, the lock body is first mounted and fixed on the external device through the buckle groove 11 of the base 10, such as on the multifunctional gun storage stand. The gun is then placed on the stabilizer 13, so that the trigger guard ring of the gun is exactly at a corresponding position of the stabilizer 13. Afterwards, the manual pressing piece 36 is pulled and pushed downwards to move the lock catch assembly 20 downwards, causing the lock beam 31 and the spring bolt 43 to resist against each other, thus forming a locked connection. At the same time, during the downward movement, the lock catch post 22 is driven by the sliding convex bar 41 of the locking assembly 40 to rotate a certain angle, so that the latch hook 23 passes through the trigger guard ring of the gun and achieve a limiting effect on the trigger guard ring of the gun, thereby locking the gun. In this case, the gun is located at an upper part of the lock body and closely abuts against the stabilizer 13, thereby achieving stand type storage, locking, and showing of the gun.

For those skilled in the art, it is apparent that the present disclosure is not limited to the details of the exemplary embodiments mentioned above, and can be implemented in other specific forms without departing from the spirit or basic features of the present disclosure. Therefore, in any perspective, the embodiments should be regarded as exemplary and non-restrictive. The scope of the present disclosure is limited by the accompanying claims rather than the above description. Therefore, all changes within the meaning and scope of the equivalent conditions of the claims within the present disclosure.

What is claimed is:

1. A lock for a gun, comprising:

a base (10);

a shell (12) fixedly connected to the base (10);

a stabilizer (13) fixedly connected to the shell (12); and a locking device (15) mounted inside the shell (12);

wherein the locking device (15) comprises a movably opened and closed lock catch assembly (20) and a locking assembly (40) restraining the lock catch assembly (20) from being movably opened and closed; wherein the lock catch assembly (20) is movably connected to the locking assembly (40), and the lock catch assembly (20) comprises a lock catch post (22); and one end of the lock catch post (22) extends into the stabilizer (13) to be engaged with a trigger guard ring of the gun when the gun is placed on the stabilizer (13), thereby keeping the trigger guard ring on the stabilizer and preventing a trigger of the gun from being driven;

wherein the lock catch assembly (20) comprises a lock beam (31), a U-shaped seat (32), and comprises a latch hook (23); and the latch hook (23) is configured to be engaged with the trigger guard ring of the gun; and lock catch assembly (20) comprises a lock beam (31), a U-shaped seat (32), and a support column (33); wherein one end of the lock beam (31) is movably connected to the locking assembly (40), and another end of the lock beam (31) is fixedly connected to the U-shaped seat (32); the support column (33) is connected to the U-shaped seat (32), passes through two side walls of the U-shaped seat (32), and protrudes out of the side walls by a certain distance; and another end of the lock catch post (22) sleeves the support column (33), thereby rotating around the support column (33) for opening and closing the lock catch assembly.

2. The lock according to claim 1, wherein the lock catch post (22) comprises a first lock post (24) and a second lock post (25) respectively sleeving two opposite ends of the support column (33); the lock catch assembly (20) comprises a torsion spring (21) sleeving the support column (33); one end of the torsion spring (21) resists against the first lock post (24), and the other end of the torsion spring (21) resists against the second lock post (25); a torsion force of the torsion spring (21) keeps the first lock post (24) and the second lock post (25) in an open state where the first lock post and the second lock post are away from each other; a sliding convex bar (41) is arranged on a side wall of the lock assembly, opposite to an opening direction of the lock catch post (22); a sliding groove (26) is arranged on one side of the lock catch post (22) opposite to the sliding convex bar (41); the sliding convex bar (41) and the sliding groove (26) cooperate with each other to enable the lock catch post (22) to slide on the side wall of the locking assembly (40); and when the lock catch assembly (20) moves into the locking assembly (40), the side wall of the locking assembly (40) defining the sliding convex bar (41) forms a limiting barrier on the lock catch post (22), causing the first lock post (24) and the second lock post (25) to rotate towards each other to form a locked state of the lock catch post.

3. The lock according to claim 1, wherein the lock catch assembly (20) comprises an unlocking spring (34) and a limiting clamp (35); the unlocking spring (34) sleeves the lock beam (31); one end of the unlocking spring (34) resists against the locking assembly (40), and another end of the unlocking spring (34) resists against the U-shaped seat; an elastic force of the unlocking spring (34) causes the lock catch assembly (20) to move towards an outside of the locking assembly (40); the limiting clamp (35) is fixedly connected to a tail of the one end of the lock beam (31) movably connected to the locking assembly (40); and the limiting clamp (35) is configured to limit a distance that the lock catch assembly (20) moves towards the outside of the locking assembly (40).

4. The lock according to claim 1, wherein the locking assembly (40) comprises a main body (400), a lock hole (42), a spring bolt (43), and a locking spring (44); the spring bolt (43) is movably connected to the main body (400); the lock beam (31) is configured to be in locking connection with the spring bolt (43) through the lock hole (42) in a locked state of the lock beam; one end of the locking spring (44) resists against the main body (400), and another end of the locking spring (44) resists against the spring bolt (43); and an elastic force of the locking spring (44) causes the spring bolt (43) to cooperate with the lock beam (31) to maintain the locked state of the lock beam.

5. The lock according to claim 4, wherein the lock catch assembly (20) comprises a manual pressing piece (36); the manual pressing piece (36) is movably connected to the shell (12); one end of the manual pressing piece (36) extends into the shell (12) and comprises a pressing groove (38), and the other end of the manual pressing piece extends out of the shell (12) and comprises a hand-pressing slider (37); the pressing groove (38) respectively resists against two ends of the support column (33) protruding out of the side walls of the U-shaped seat; the pressing groove (38) of the manual pressing piece (36) drives the U-shaped seat (32) and the lock beam (31) to be synchronously the hand-pressing slider (37), so that the spring bolt (43) and the lock beam (31) cooperate with each other to form the locked state of the lock beam.

6. The lock according to claim 4, wherein the locking device (15) comprises a mechanical lock (45) and a mechanical cam (46); the mechanical lock (45) is fixedly connected to the shell (12), and the mechanical cam (46) is fixedly connected to a rotating shaft of the mechanical lock (45); and when the mechanical lock (45) is unlocked by an external key, the key is turned to cause the rotating shaft to synchronously rotate and drive the mechanical cam (46) to rotate, thereby pushing the spring bolt (43) to move a certain distance away from the lock beam (31) to form an unlocked state of the lock beam.

7. The lock according to claim 4, wherein the locking device (15) comprises an electronic unlocking device (50); the electronic unlocking device (50) comprises a reduction motor (51), an electric cam (52), a touch switch (53), a circuit board (54), a power assembly (55), and a power inputting assembly (57); the reduction motor (51), the touch switch (53), and the circuit board (54) are fixedly connected to the locking assembly (40) respectively; the electric cam (52) is fixedly connected to a rotating shaft of the reduction motor (51); the power assembly (55) is fixedly connected to the circuit board (54); the reduction motor (51) is configured to be controlled to rotate after the power inputting assembly (57) receives a correct preset password, thus driving the electric cam (52) to rotate synchronously and then pushing the spring bolt (43) to move a certain distance away from the lock beam (31) to form an unlocked state of the lock beam; and when the spring bolt (43) moves the certain distance and resists against the touch switch (53), the reduction motor (51) is controlled to stop rotating.

8. The lock according to claim 7, wherein the electronic unlocking device (50) comprises a fingerprint recognition assembly (58) configured to receive a correct preset fingerprint; and after the fingerprint recognition assembly (58) receives the correct preset fingerprint, the reduction motor (51) is controlled to rotate, thus driving the electric cam (52) to rotate synchronously and then pushing the spring bolt (43) to move the certain distance away from the lock beam (31) to form the unlocked state of the lock beam.

9. A multifunctional gun storage stand, comprising: the lock according to claim 1; and a stand body (70), wherein the stand body (70) comprises a lock fixing seat (71), a placement frame (72), a stacking frame (73), a card holder slot (74), and a storage slot (75); the base (10) of the lock comprises a buckle groove (11); and the buckle groove (11) is configured to be buckled on the lock fixing seat (71), so that the lock is fixedly connected to the stand body (70).

* * * * *